US005791072A

United States Patent [19]

Schbot

[11] Patent Number: 5,791,072

[45] Date of Patent: Aug. 11, 1998

[54] SNOWPLOW WITH ADJUSTABLE HANDLE

[76] Inventor: Michel Schbot, 4424 Elan Pl., Annandale, Va. 22003

[21] Appl. No.: 785,917

[22] Filed: Jan. 21, 1997

[51] Int. Cl.[6] ..... E01H 5/02

[52] U.S. Cl. ..... 37/278; 37/273; 37/283; 37/284; 294/57; 403/96

[58] Field of Search ..... 37/278, 279, 283, 37/284, 285, 272, 273; 172/371, 372; 294/54.5, 56, 57; 403/96

[56] References Cited

U.S. PATENT DOCUMENTS

| | | | |
|---|---|---|---|
| 157,078 | 11/1874 | Parker et al. | 37/278 X |
| 323,656 | 8/1885 | Franz | 37/278 X |
| 731,419 | 6/1903 | Wykoff | 37/278 X |
| 745,608 | 12/1903 | Heermans | 37/278 X |
| 956,896 | 5/1910 | Gross | 37/278 X |
| 1,276,672 | 8/1918 | Mason, Jr. | 37/278 X |
| 1,307,410 | 6/1919 | Morris | 37/278 X |
| 1,665,733 | 4/1928 | Clark | 37/272 |
| 1,678,113 | 7/1928 | Gustafson | 37/272 X |
| 1,820,692 | 8/1931 | Cooper | 37/278 X |
| 2,231,268 | 2/1941 | Hoare | 37/272 |
| 2,333,360 | 11/1943 | Churchill | 37/273 |
| 5,165,144 | 11/1992 | Nisenbaum | 294/54.5 X |

FOREIGN PATENT DOCUMENTS

| | | | |
|---|---|---|---|
| 153537 | 2/1956 | Sweden | 37/278 |

*Primary Examiner*—Terry Lee Melius
*Assistant Examiner*—Victor Batson

[57] ABSTRACT

An adjustable snowplow designed to remove snow and other materials from various surfaces by pushing the snowplow along the surface. The adjustable snowplow has a handle attached to twin, mirror imaged, curved, blades which are adjustably joined to each other at their respective inner end to form a unitary plow blade. The width or footprint of the plow can be adjusted by angling the blades closer or further from each other to plow a narrower or wider path depending on the task at hand. The symmetry of the blades about the length of the attached handle causes snow and other materials pushed by the plow to be distributed equally to either side of the plow.

3 Claims, 3 Drawing Sheets

SNOWPLOW WITH ADJUSTABLE HANDLE

BACKGROUND OF THE INVENTION

1. Field of the Invention

The present invention is directed to a snowplow or snow shovel which is effective and efficient in removing snow and other materials in less time and requires less physical effort to perform the task. The shovel may also be used for a variety of other purposes besides the removal of snow, such as the removal of sand, gravel, or other aggregates and liquids.

2. Prior Art Statements

There are a number of different kinds of shovels and plows available on the market for removing snow and other materials. Typically, these shovels and plows follow a consistent design with a vertical blade attached to a rigid handle. In some cases a variable width path can be cleared by using a multi-part V-shaped blade wherein some portions of the blade may be rotated relative to each other. One such device is shown in U.S. Pat. No. 1,820,692 to Cooper. In the Cooper device, the portions of the blades behind a fixed angle nose portion can be angled towards each other to clear a smaller path.

However, prior art shovels have had the drawback that they have all been configurable into only a limited combinations of angles. The device of the present invention goes beyond the prior art devices by offering to the user the ability to manipulate all of the angles on the shovel independently. The width of the path can be changed independently of the angle of the handle. The handle can be moved to a position asymmetric to the center line of the shovel blades to apply more pressure to one side of the shovel. And finally, the front edge of the shovel, where opposing blades of the shovel are joined, may be varied to control the width of the path cleared by the blades, and also to vary the angle of attack of the shovel through the snow to break up harder chunks of ice and hard packed snow. In addition the plow has the additional improvement that a bumpstop has been provided at the front edge of the shovel to allow the shovel to glide over step-ups in and/or cracks in the sidewalk.

SUMMARY OF THE INVENTION

The present invention is directed to a snow plow or snow shovel having two opposing blades with outwardly curved upper edges and straight forward edges. The shovel has an adjustable connector assembly attached to the blades behind the forward edge by variable length arms such that as the arms are lengthened, the blades are angled further apart from each other. In addition, a handle is attached to the shovel by a height adjustment mechanism which allows the angle of the shovel and the blades to be varied independently of the current angle between the blades. The shovel can be made of metal, hard plastic, or any combination of these or other materials.

It is an object of the present invention to provide an improved snow shovel having two opposing blades attached to each other and having a variable angle between the blades.

It is another object of the invention to provide a snow shovel having a blade adjustment means for varying and maintaining the angle of the blades to the shovel.

It is a further object of the invention to provide an improved snow shovel having a handle height adjustment means which is independently adjustable from the blade adjustment means.

It is also an object of the invention to provide an blade adjustment means which receives the handle of the snow shovel and can be laterally offset from the center line of the shovel to apply a greater amount of force on one blade or the other.

It is an object of the invention to provide improved elements and arrangements thereof in an apparatus for the purposes described which is inexpensive, dependable and fully effective in accomplishing its intended purposes.

It is another object of this invention to provide a snow plow which can easily climb over obstacles and cracks without damaging the plow or causing undue shock to the user.

These and other objects of the present invention will become readily apparent upon further review of the following specification and drawings.

DETAILED DESCRIPTION OF THE INVENTION

Figure 1:
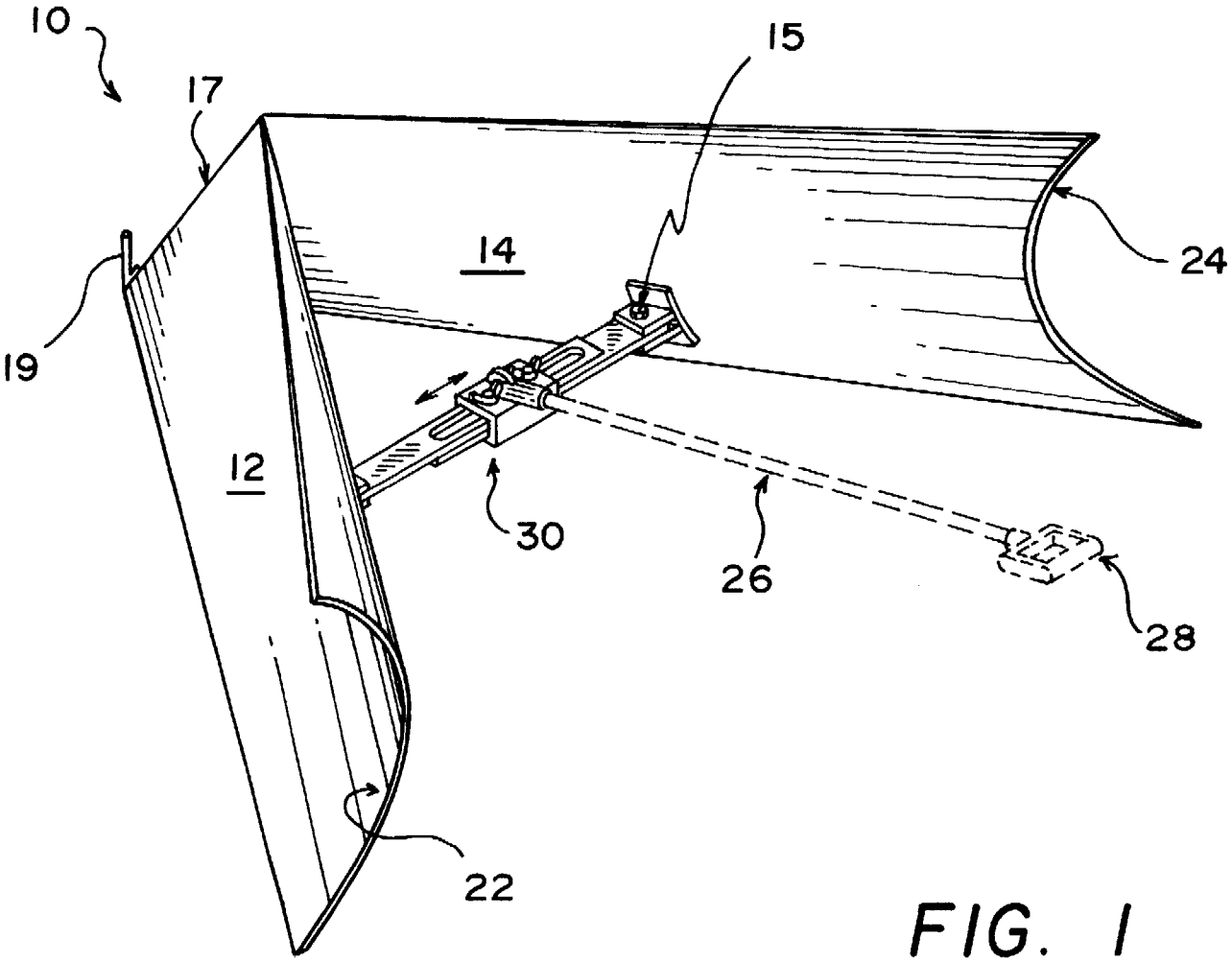
FIG. 1 is an environmental perspective of the adjustable snowplow.
Figure 2:
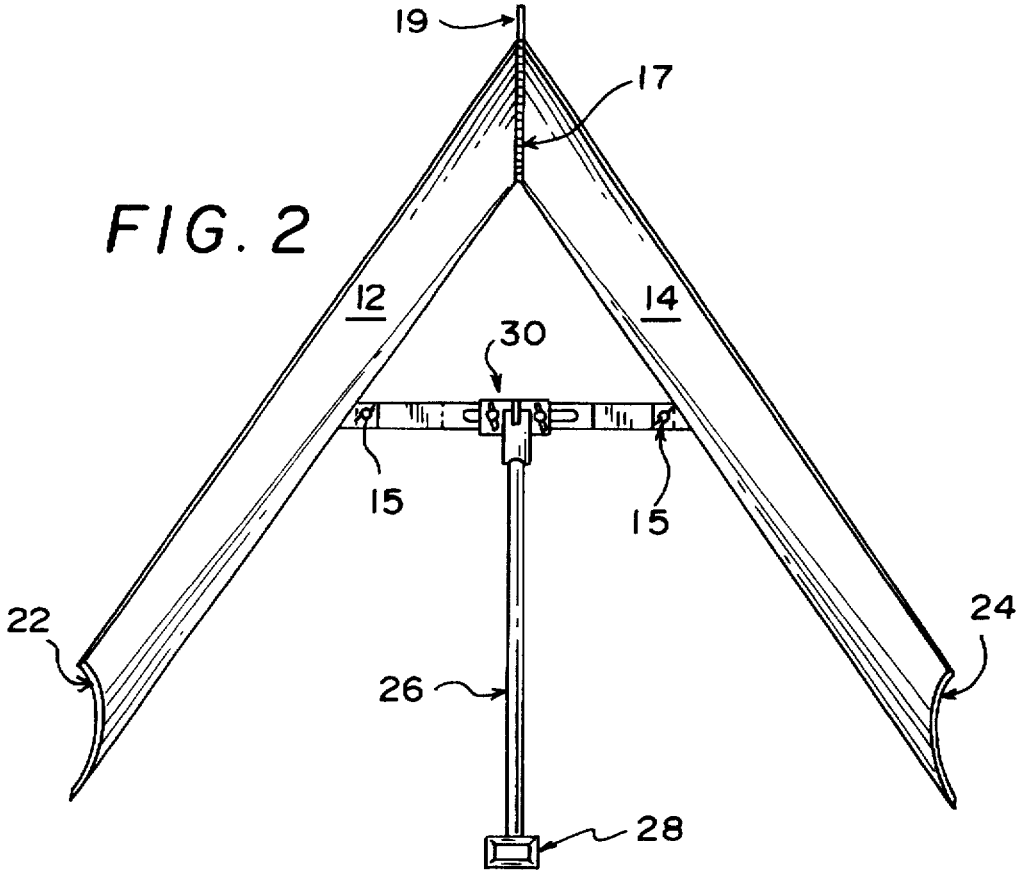
FIG. 2 is the top plan view of the adjustable snowplow.

Referring now to FIG. 1, a snow shovel 10 according to the present invention is shown. Blades 12 and 14 are attached to each other along their forward edge 17. Forward edge 17 as best seen in FIG. 2 is hinged such that blades 12 and 14 may rotate relative to each other. To accommodate rotation of the blades relative to each other, the front edges of each blade are generally straight such that all portions of the front edge of each blade can remain in contact throughout the full rotation of the blades. If a curved front blade edge were used, a gap would appear at some point along the front edge allowing snow or other shoveled materials to seep between the blades, reducing the overall efficiency of the blade assembly.

A adjustable connector assembly 30 is connected by two opposing connector plates 34, 36 which are in-turn connected to hinge pieces 15 to allow the plates to rotate relative to the blades. Situated at the top of the adjustable connector is a height adjustment means 32 which connects the handle assembly 26 to the snow shovel.

As best seen in FIGS. 1–4, each adjustable blade 12,14 has an upper, outwardly turned edge 22,24. The graduated concave surfaces 22,24 which begin near the front edge 17 as a nearly flat vertical surface smoothly graduating to a more pronounce curved surface at the opposite end of the blade away from the forward edge. The outwardly curved edges 22,24 operate to direct snow outwardly and away from the user and the shovel as the snow follows the contour of the blade during forward motion of the shovel.

Figure 5:
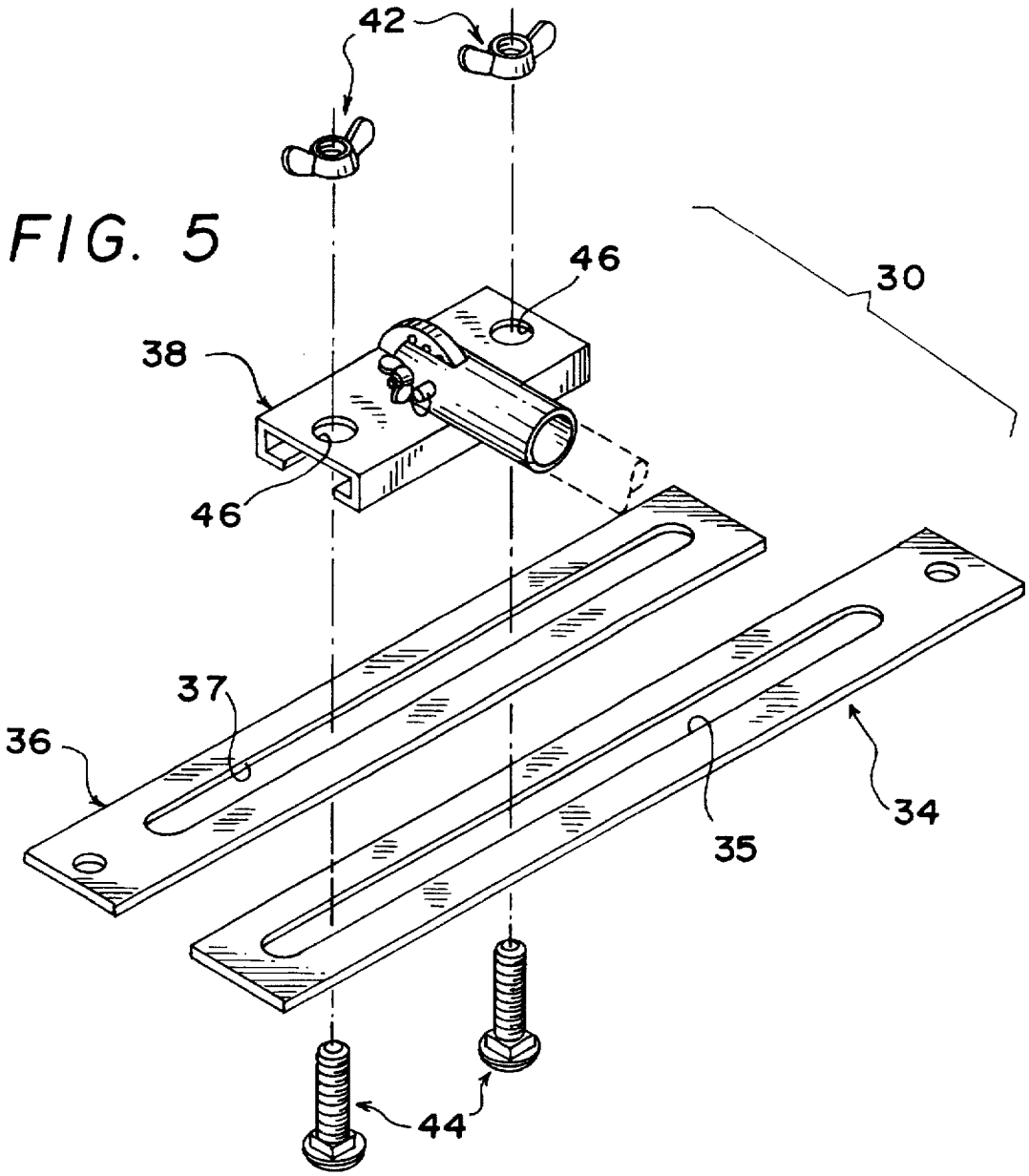
FIG. 5 is an exploded view of an adjustable connector which connects the two identical blades.
Figure 6:
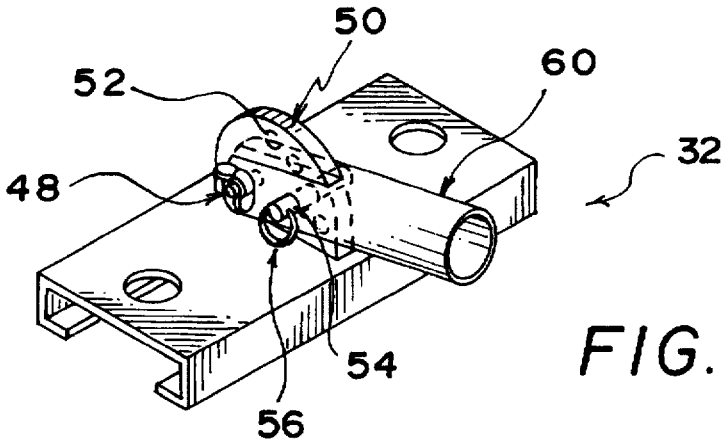
FIG. 6 is a detailed perspective of the adjustable connector of the snowplow.

Referring now to FIG. 5, the adjustable connector assembly which is located at the center of the snow shovel has a clamping plate 38 adapted to fit over and retain first and second connector plates or control arms 34, 36. Two apertures 46 are defined in the clamping plate for receiving two bolts 44 therethrough. Each connecting plate 34,36 has a respective slot 35,37 defined therein. The clamping plate apertures are aligned with connector plate slots 35,37 to receive bolts 44 therethrough. Nuts 42 are provided also to secure bolts 44 in place. As is well known in the art, adjustment of the tension on the bolts 44 is controlled by nuts 42 so as to control whether the control arms 34,36 can slide relative to clamping plate 38 or are fixed relative to the plate.

Figure 3:
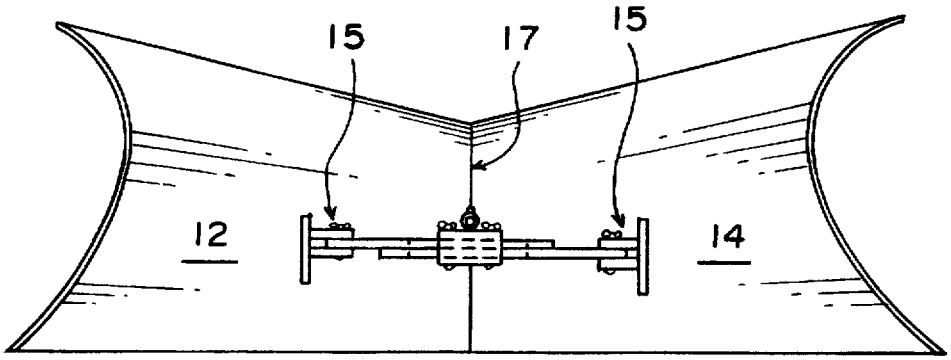
FIG. 3 is a rear elevational view of the adjustable snowplow.
Figure 4:
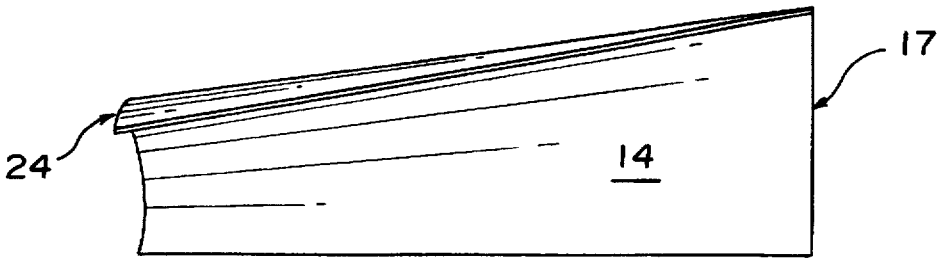
FIG. 4 is a view of one side of one blade (of the two identical blades) of the adjustable snowplow.

As best shown in FIG. 1–3, the ends of the connector plates are attached to the opposing blades 12,14 by hinge members 15. The connector plate is bolted or pinned or connected in other manners well known to those skilled in the arts such that the connector plate can rotate about the bolt or pin or other connector. This is important so that no stresses are imposed on the connector plates by the rotation of the blades outwardly from each other. As the relative angle between the blades changes, the angle between the blades and the connector plates changes, and the rotation capability provided by the hinges allows any torque forces which may develop between the blades and the connector plates during rotation of the blades to be relieved.

As best seen in FIGS. 1,2,5, and 6, the snow shovel height adjustment means 32 includes a central hinging point 48 which is shown as a bolt and nut, but may comprise any number of well known equivalent devices. A semicircular section plate 50 defines a plurality of holes 52 which are adapted to receive a pintle 54 therethrough. The pintle may include a pull tab 56 which controls an internal locking device (not shown) to maintain the pintle in place during operation. Such locking pintles having cam operated detents are well known in the art and will not be discussed further here. A cylindrical receiver tube 60 is attached at one end by the hinging means 48 and has an aperture defined therethrough which can be aligned with any of the plurality of holes 52 in the section plate 50 and secured by a pintle 54 in a predetermined position relative to the shovel. The particular hole 52 which the handle is attached to can be changed to provide for users of different heights and to change the leverage applied by the user to the shoveled medium through the shovel.

The cylindrical receiver tube 60 is adapted to receive an elongated handle assembly 26. The handle assembly includes an elongated shaft and a handle means 28. The handle means may be omitted or replaced by a number of connecting devices for connecting the shovel to a machine or to make the handle more readily acceptable by a handicapped or other individual.

Returning again to the operation of the adjustable connector, in normal operation the connector plate 30 will be centered between the two opposing blades 12, 14, and the connector plates 34, 36 will be secured in place to maintain the blades at a predetermined angle. However, when the shovel is used to clear a space along a wall, or where one edge of the shovel is in a clearing and the other edge is contacting the medium to be shoveled, it may be desirable to increase the amount of force applied to one blade over the other. In such circumstances, the nuts 42 can be rotated to reduce tension on the bolts 44, allowing the adjustable connector to slide freely over the connector plates. The adjustable connector can then be translated laterally toward one blade and secure in place by re-tightening nuts 42 with or without changing the relative angle of the shovel blades. With the adjustable connector positioned eccentricity along the connector plates with respect to the opposing blades, the handle which is connected to the height adjustment means located above the adjustable connector will also be situated asymmetrically with respect to the blades. Therefore, in operation, the force applied to the handle or the handle assembly will be applied eccentricity with respect to the shovel causing a greater force on one blade or the other according to the current configuration of the blades. This will allow for more efficient shoveling of snow when there is an unequal amount of snow sides of the shovel.

In addition, the snow plow has an additional feature which aids in the ease of use of the snow plow to the user. Referring to FIG. 1, the shovel has a ramp portion 19 or a bumper ramp attached to the front edge of the first adjustable blade which allows the shovel to be pushed across cracks in a sidewalk or to easily slide up vertical jumps in the sidewalk. If the sidewalk is cracked and there is a vertical face in the sidewalk in front of the plow, a shovel with a vertical face or a downwardly sloped face would stop when the plow hits the face of the crack. The ramp portion 19 of the present snow plow instead hits the wall about the outer front face of the ramp piece. Forward motion then allows the plow to climb the jump in the sidewalk as the outer contour of the ramp slides along the top ridge of the vertical face of the jump in the sidewalk until the plow is completely onto the higher sidewalk portion. This prevents damage to the plow and prevents shock waves from traveling to the user. The bumper ramp piece may have a circular cross-section or a v-shaped cross-section for a high strength to weight ratio and may be built out of any suitable material, including, but not limited to plastics and metals.

Obviously, one skilled in the art would envision immediately numerous equivalent methods of connecting and securing the parts of the shovel together which would not depart from the underlying principles and teachings of this invention. Therefore it is understood that without exceeding the scope of the claims, many equivalent means can be used to undertake the teachings of this invention other than as specifically described herein.

I claim:

1. A handle pushed adjustable snowplow comprising:

a plow blade assembly including a first and a second blade each arranged in a generally vertical disposition and having forward generally straight mating edges, said first and second blades being connected along their respective forward mating edges about an upright pivot axis for angular movement toward and away from each other about said pivot axis, each said blade including a lower scraping edge, an upper edge, and a rearward edge, an adjustable connector assembly, said adjustable connector assembly comprising first hinge means attached to said first blade and second hinge means attached to said second blade, first and second control arms hingedly attached to respective said first and second hinge means, an adjustable clamping plate for securing said first and second control arms in overlapping relationship in angularly adjusted position about said upright pivot axis, an elongated handle having upper and lower ends and including a pair of longitudinally spaced openings at the lower end thereof, said adjustable clamping plate including handle securing and angular adjustment means comprising an upright sector plate secured to said clamping plate, said sector plate including transversely disposed pivot pin means pivotally securing said handle through one of said handle openings for pivotal movement about a fixed axis with respect to said clamping plate, said upright sector plate including a plurality of arcuately disposed openings equally spaced from said pivot pin means, and locking pin means for selectively locking said handle in a selected angularly adjusted position said locking pin means extending through one of said arcuately disposed openings and the other of said handle openings, wherein the adjustable clamping plate is slidable along said control arms and securable centrally between the hinge means or in a laterally adjusted position closer to one hinge means than to the other whereby the handle may be offset closer to one blade than to the other and wherein each control arm includes an elongated slot slidably receiving elongated fastener means extending through each elongated slot and through an opening in said clamping plate.

2. The adjustable snowplow recited in claim 1 wherein a upper portion of each blade is curved forwardly increasingly from near their respective forward mating edges toward their rearward edges.

3. The adjustable snowplow recited in claim 1 further including an obstruction climbing ramp means secured to the plow blades adjacent the upright pivot axis.

* * * * *